US008556730B2

(12) United States Patent
Jo

(10) Patent No.: US 8,556,730 B2
(45) **Date of Patent: *Oct. 15, 2013**

(54) GAMING DEVICE DISPLAY HAVING A DIGITAL IMAGE AND SILKSCREEN COLORS AND PROCESS FOR MAKING SAME

(75) Inventor: Jeffrey H. Jo, Reno, NV (US)

(73) Assignee: IGT, Las Vegas, NV (US)

( * ) Notice: Subject to any disclaimer, the term of this patent is extended or adjusted under 35 U.S.C. 154(b) by 1798 days.

This patent is subject to a terminal disclaimer.

(21) Appl. No.: 10/210,516

(22) Filed: Jul. 31, 2002

(65) Prior Publication Data

US 2003/0073484 A1 Apr. 17, 2003

Related U.S. Application Data

(60) Provisional application No. 60/329,807, filed on Oct. 15, 2001.

(51) Int. Cl.
*A63F 9/24* (2006.01)

(52) U.S. Cl.
CPC ..... *A63F 9/24* (2013.01)
USPC ..... 463/46

(58) Field of Classification Search
CPC ..... A63F 9/24; A63F 13/00
USPC ..... 463/46; 40/219
See application file for complete search history.

(56) References Cited

U.S. PATENT DOCUMENTS 2,114,711 A 4/1938 Horinstein
2,372,124 A 3/1945 Schenkel
4,326,351 A * 4/1982 Heywood et al. ..... 40/467
4,337,590 A * 7/1982 Jackson ..... 40/615
4,391,853 A * 7/1983 Pointon ..... 427/152
4,505,497 A 3/1985 Katzman
4,682,709 A * 7/1987 Brandes et al. ..... 221/2
4,995,185 A 2/1991 Cheng (Continued)

FOREIGN PATENT DOCUMENTS

EP 0896308 2/1999
GB 2218561 A * 11/1989 ..... G09F 13/00

(Continued)

OTHER PUBLICATIONS

Kodak Professional Duraclear Display Material (website) written by www.kodak.com, printed Oct. 12, 2001.

*Primary Examiner* — Kesha Frisby

(74) *Attorney, Agent, or Firm* — Neal, Gerber & Eisenberg LLP

(57) ABSTRACT

A panel or reel strip of a gaming device that selectively enables light to shine through the panel or reel strip and enables the intensity of the light to be varied. The present invention also provides an efficient and productive method for developing and producing the panel or reel strip, and which provides a bright and rich color quality. In one embodiment, a transparent medium has a digital image produced on one side and has a layer of silk-screened ink placed on the opposite side. The non-inked areas enable back-lighting to make matching colors of the digital image appear to glow, that is, let a high amount of light pass through the medium. The inked areas enable outside light to reflect off the matching colors of the digital image, brightening such colors and making them appear rich and full of color.

33 Claims, 5 Drawing Sheets

(56) References Cited

U.S. PATENT DOCUMENTS

| | | | | | |
|---|---|---|---|---|---|
| 5,352,532 | A | * | 10/1994 | Kline | 428/447 |
| 5,442,461 | A | * | 8/1995 | Levien | 358/3.19 |
| 5,505,801 | A | * | 4/1996 | Harris | 156/100 |
| 5,625,968 | A | * | 5/1997 | Ashall | 40/546 |
| 5,897,735 | A | | 4/1999 | Peskin | |
| 5,927,191 | A | | 7/1999 | Wheatley, Jr. et al. | |
| 6,027,115 | A | * | 2/2000 | Griswold et al. | 273/143 R |
| 6,038,977 | A | | 3/2000 | Haney et al. | |
| 6,217,186 | B1 | | 4/2001 | Fisher | |
| 6,244,183 | B1 | | 6/2001 | Haney et al. | |
| 6,308,444 | B1 | | 10/2001 | Ki | |
| 6,368,758 | B1 | * | 4/2002 | Camp et al. | 430/12 |
| 6,526,681 | B1 | * | 3/2003 | De Saro | 40/564 |
| 6,543,163 | B1 | * | 4/2003 | Ginsberg | 40/219 |
| 6,588,131 | B2 | * | 7/2003 | O'Connell, Jr. | 40/446 |
| 6,606,168 | B1 | | 8/2003 | Rylander | |
| 2003/0073484 | A1 | * | 4/2003 | Jo | 463/20 |

FOREIGN PATENT DOCUMENTS

| | | | | | |
|---|---|---|---|---|---|
| GB | 2239547 | A | * | 7/1991 | G07F 17/34 |
| GB | 2 306 746 | A | | 5/1997 | |
| GB | 2 358 513 | A | | 7/2001 | |
| JP | 08328492 | A | | 12/1996 | |
| JP | 2001034210 | A | | 2/2001 | |
| WO | WO 98/42518 | | | 10/1998 | |
| WO | WO 00/67049 | | | 11/2000 | |
| WO | WO 02/17282 | A1 | | 2/2002 | |

* cited by examiner

GAMING DEVICE DISPLAY HAVING A DIGITAL IMAGE AND SILKSCREEN COLORS AND PROCESS FOR MAKING SAME

PRIORITY CLAIM

This application is a non-provisional application which claims the benefit of U.S. Patent Provisional Application Serial No. 60/329,807, filed Oct. 15, 2001.

CROSS REFERENCES TO RELATED APPLICATIONS

This application is related to the following commonly-owned co-pending patent applications: "GAMING DEVICE DISPLAY WITH SIMULATED HALFTONES," Ser. No. 10/243,898.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates to gaming devices. More particularly, the present invention relates to a gaming device having a multicolored display panel and a method for making gaming devices.

Gaming device manufacturers provide gaming machines such as slot machines employing a plurality of reels which each have a plurality of symbols. In these gaming machines, the player spins the reels, which produce a random generation of a combination of symbols. If the generated combination or a portion of the combination matches one of a number of predetermined award producing or winning combinations, the player receives an award. The award is commonly one or more credits that the player can play or redeem for money.

Gaming device manufactures also provide video poker games that generate credits for the player. The player can either use the awarded credits to play more poker hands or redeem the credits for money. These examples as well as many other types of gaming machines award credits to the player.

To increase player enjoyment and excitement, and to increase the popularity of the gaming machines, gaming device manufacturers constantly strive to make their gaming devices as fun, exciting and attractive as possible. Certain manufactures therefore go to great lengths in creating artwork that provides a distinct look and feel to each gaming machine and that also conveys a theme for the machine. When a player is deciding which machine to play, the player may pick the one that "looks" like the most fun or looks the most attractive.

Historically, gaming device manufacturers have used a well known silk screening process to color the glass or plastic that often resides above and in front, below the reels or video displays and other controls of the gaming device. While silk screening provides relatively satisfactory results, it has certain disadvantages. For example, a separate screen must be made for each color that is to be applied to the glass or plastic. The manufacturer brings a first screen into registry with the glass or plastic to apply the first color. The first color must dry before a second color is applied and so on. The preparation of a silk-screened, multicolored gaming device panel is therefore time consuming and cumbersome. Another disadvantage with known silk-screening techniques is that certain colors or shades of colors known such as flesh tones or halftones have typically not been suitably achieved.

One solution to the problems associated with silk-screening is to use digital imaging instead of silk screening to create a design on the glass or plastic panel. There are many devices that produce digital images on a clear media. This media can be adhered to a piece of glass, plastic or mirror. These devices include standard color printers or more advanced dry film printers or drum-type printers. A problem with digital imaging is that the colors produced by the digital printers are typically not rich as colors produced by conventional screen printing. That is, too much light shines through the imaged surface and the images do not reflect outside light well.

For gaming devices, while digital imaging is flexible, repeatable and efficient, silk-screening typically provides a richer looking panel. A need therefore exists to provide an apparatus and method that combines the benefits individually provided by silk-screening and digital images in the production of gaming device displays.

SUMMARY OF THE INVENTION

The present invention provides a panel, reel strip or other display of a gaming device that selectively enables light to shine through the panel or reel strip and enables the intensity of the light to be varied. The present invention also provides an efficient and productive method for developing and producing the panel, reel strip or other display and which provides a bright and rich color quality. In one embodiment of the present invention, a transparent medium has a digital image produced on one side and has a layer of silk-screened ink placed on the opposite side. The non-inked areas enable backlighting to make matching colors of the digital image appear to glow (i.e., let a high amount of light pass through). The inked areas enable outside light to reflect off the matching colors of the digital image, brightening such colors and making them appear rich or full of color.

The process to produce the panel, reel strip or display is efficient, flexible, repeatable and is less costly than typical silk-screening processes that require multiple stencils or screens and multiple inking sessions and cure periods. The process often only requires one layer of silkscreen ink, which in one embodiment is white to enable some light to pass through the matching colors of the digital image. For certain designs, the present invention may require more than one layer of ink, but less than the layers required for silk-screening the same designs. The layer of white ink makes portions of the transparent medium non-transparent. Other portions of the transparent medium are left transparent, where the designer wishes the panel or reel strip to glow. The designer can alternatively silkscreen darker and darker or even black ink, or combinations thereof, to make the digital image colors appear more and more opaque. Also, if the digital image produces dark blue or black colors, the corresponding areas having these colors can appear virtually opaque.

In another embodiment, a plurality of silkscreen layers are applied, which selectively make portions of the panel, reel strip or display opaque or translucent. Here, a white silk-screen layer is applied to a reverse side of the transparent medium from the digital image. The white layer makes the transparent medium translucent. A dark or black layer of ink is selectively silk-screened onto the white ink layer, making those areas opaque. In this embodiment, the entire panel, reel strip or display appears rich and bright due to the initial layer of white ink.

The portions of the white silk-screened side of the medium that are not additionally silk-screened with dark colors enable some back lighting to shine through and cause selected symbols or indicia to be highlighted relative to the opaque colors. The portions of the white silkscreen side of the medium that do have additional silk-screened layers appear even fuller or richer. In this alternative arrangement, certain areas of the medium can be left transparent to further highlight selected areas. It should be appreciated that the two or three silk-screened layers of this embodiment still provide a substantial reduction in time, cost and energy from registering silk-screening and multiple colors as is presently known.

Each of the above embodiments preferably includes a protective coating, which protects the silk-screened ink from environmental hazards and from damage due to handling. Also, each of the above embodiments can include a layer of adhesive or other device for enabling the medium to adhere or attach to a panel or substrate, such as a piece of glass or plastic.

It is therefore an advantage of the present invention to provide a gaming device display produced by a method that combines the benefits individually provided by silk-screening and digital imaging.

Another advantage of the present invention is to provide a method that efficiently produces multicolored gaming device displays.

A further advantage of the present invention is to provide repeatable multicolored gaming device displays.

Yet another advantage of the present invention is to provide a method that fosters flexibility, complexity and versatility in the design of multicolored gaming device displays.

Still another advantage of the present invention is to provide a method for producing multicolored gaming device displays that reduces the cost, development time, prototyping time and lead time associated with silk-screening.

An additional advantage of the present invention is to provide a method for producing multicolored gaming device displays that increases the productivity of silk-screened displays.

Still a further advantage of the present invention is to provide a multicolored gaming device display that has enhanced color saturation, color richness and color reflectivity.

Still another advantage of the present invention is to provide a multicolored gaming device display having translucently colored areas.

Still another advantage of the present disclosure is to provide a gaming device display having a composite image including a silk-screened image component and a digital image component.

Additional features and advantages of the present invention are described in, and will be apparent from, the following Detailed Description of the Invention and the figures.

DETAILED DESCRIPTION OF THE INVENTION

Gaming Device and Electronics

Figure 1A:
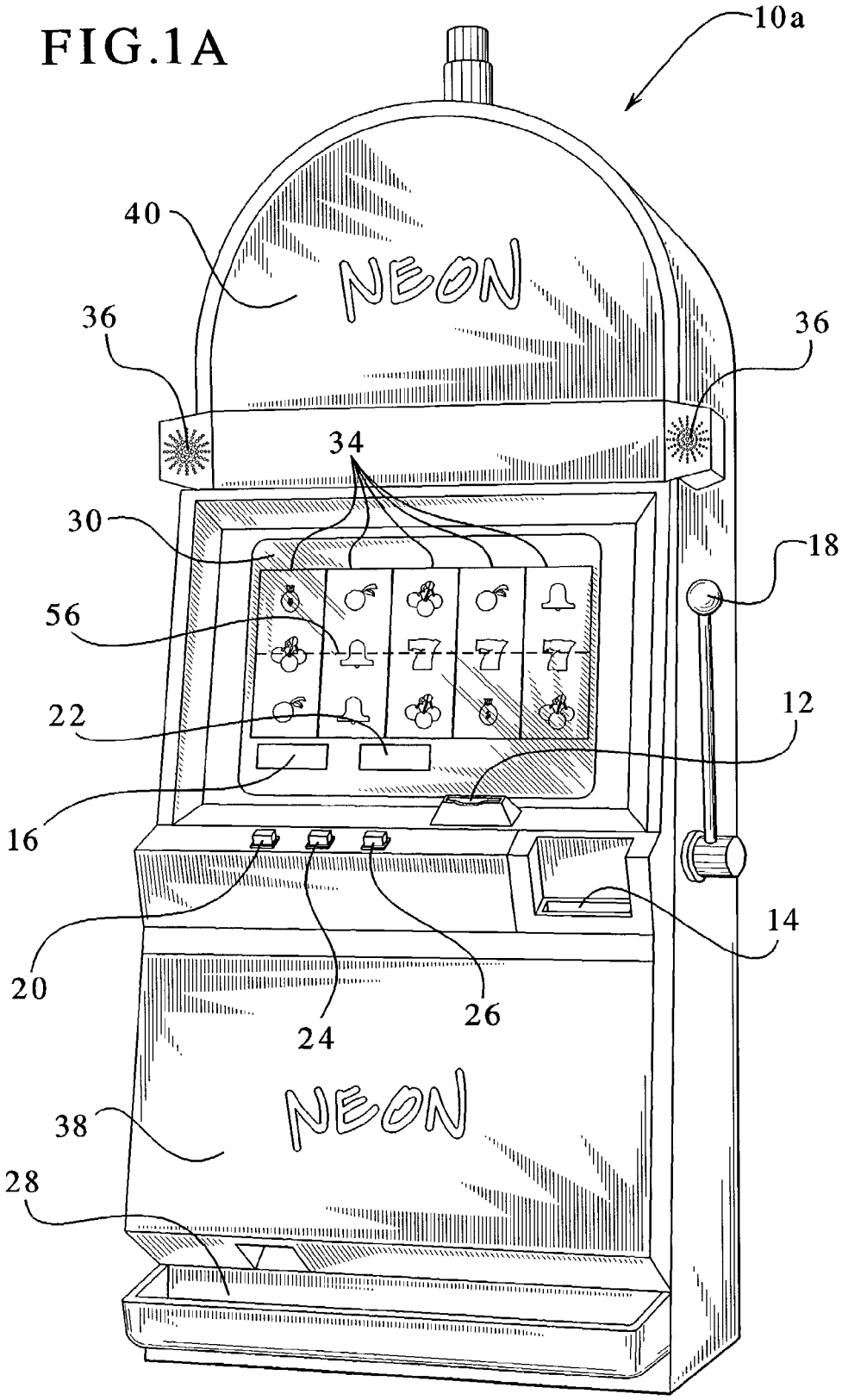
FIGS. 1A and 1B are perspective views illustrating alternative embodiments of the gaming device of the present invention.
Figure 1B:
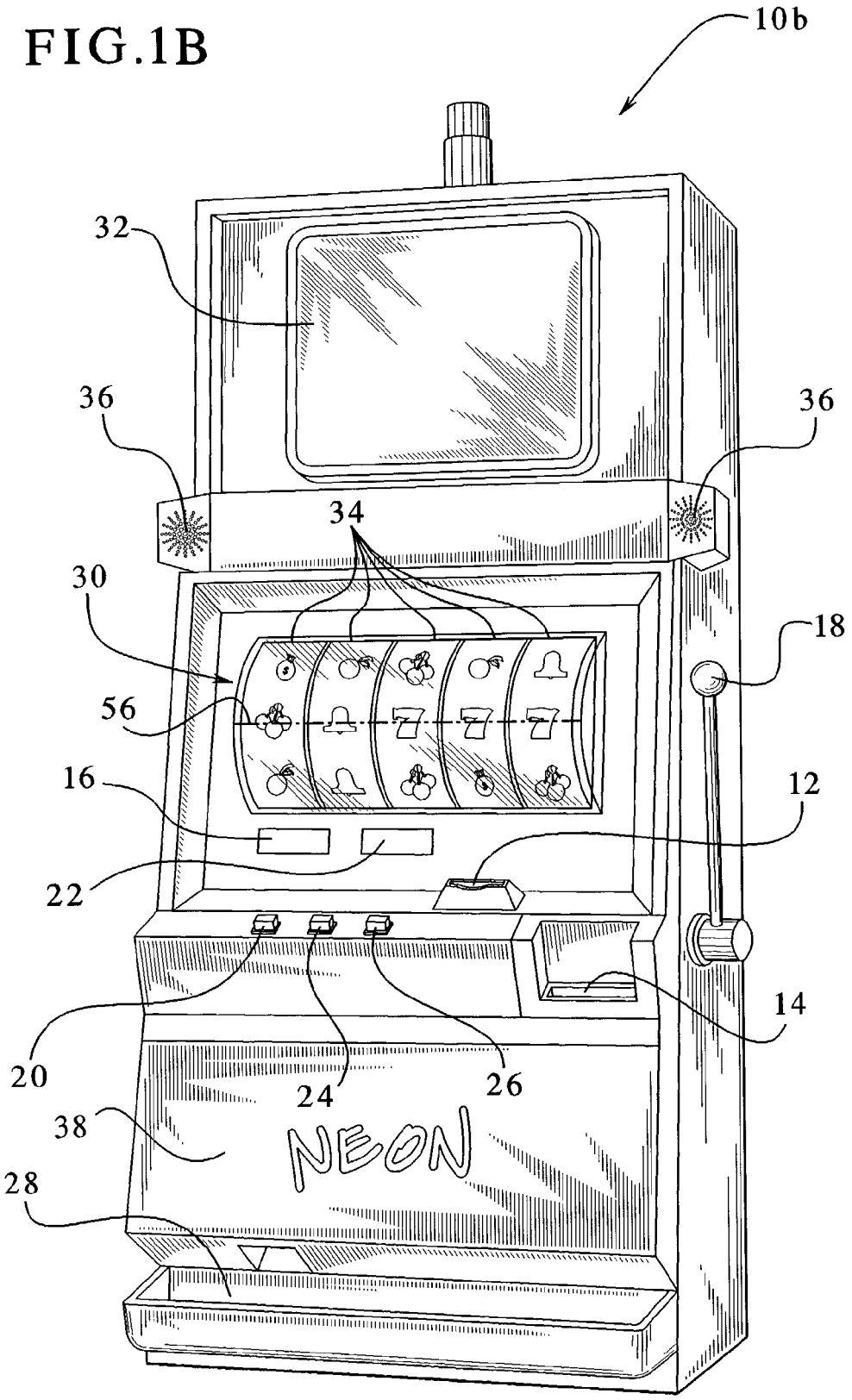

Referring now to the drawings, and in particular to FIGS. 1A and 1B, gaming device 10*a* and gaming device 10*b* illustrate two possible cabinet styles and display arrangements and are collectively referred to herein as gaming device 10. The gaming device of the present invention has the controls, displays and features of a conventional gaming machine. The player may operate the gaming device while standing or sitting. Gaming device 10 also includes slant top style gaming device (not shown), which a player operates while sitting.

The gaming device 10 may include any slot, poker, blackjack, keno, or other base or primary game. The gaming device 10 may also include any secondary or bonus triggering events, bonus or secondary games as well as any progressive game coordinating with these base or bonus games. The symbols and indicia used for any of the base, bonus and progressive games include mechanical, electronic, electrical or video symbols and indicia.

The gaming device 10 preferably includes monetary input devices. FIGS. 1A and 1B illustrate a coin slot 12 for coins or tokens and/or a payment acceptor 14 for cash money. The payment acceptor 14 may also include other devices for accepting payment, such as readers or validators for credit cards, debit cards or smart cards, tickets, notes, etc. When a player inserts money in gaming device 10, a number of credits corresponding to the amount deposited is shown in a credit display 16. After depositing the appropriate amount of money, a player begins the game by pulling arm 18 or pushing play button 20.

As shown in FIGS. 1A and 1B, gaming device 10 also includes a bet display 22 and a bet one button 24. The player places a bet by pushing the bet one button 24. The player increases the bet by one credit each time the player pushes the bet one button 24. When the player pushes the bet one button 24, the number of credits shown in the credit display 16 decreases by one, and the number of credits shown in the bet display 22 increases by one. A player may "cash out" by pushing a cash out button 26 to receive coins or tokens in the coin payout tray 28 or other forms of payment, such as an amount printed on a ticket or credited to a credit card, debit card or smart card.

Gaming device 10 also includes one or more display devices. The embodiment shown in FIG. 1A includes a central display device 30, and the alternative embodiment shown in FIG. 1B includes a central display device 30 as well as an upper display device 32. The display devices display any visual representation or exhibition, including but not limited to movement of physical objects such as mechanical reels and wheels, dynamic lighting and video images. The display device includes any viewing surface such as glass, a video monitor or screen, a liquid crystal display or any other static or dynamic display mechanism. In a video poker, blackjack or other card gaming machine embodiment, the display device includes displaying one or more cards. In a keno embodiment, the display device includes displaying numbers.

If the primary game is a slot game, the slot base game of gaming device 10 preferably displays a plurality of reels 34 such as three to five reels 34 in mechanical or video form on one or more of the display devices. Each reel 34 displays a plurality of indicia such as bells, hearts, fruits, numbers, letters, bars or other images or symbols which preferably correspond to a theme associated with the gaming device 10. If the reels 34 are in video form, the display device displaying the video reels 34 is preferably a video monitor. Each gaming device 10 includes speakers 36 for making sounds or playing music as described below.

With reference to the slot machine base game of FIGS. 1A and 1B, to operate the gaming device 10, the player inserts the appropriate amount of tokens or money in the coin slot 12 or the payment acceptor 14 and then pulls the arm 18 or pushes the play button 20. The reels 34 then begin to spin. Eventually, the reels 34 come to a stop. As long as the player has credits remaining, the player can spin the reels 34 again. Depending upon where the reels 34 stop, the player may or may not win additional credits.

In addition to winning base game credits, the gaming device 10 may also include one or more bonus games that give players the opportunity to win credits. The gaming device 10 may employ a video-based display device 30 or 32 for the bonus games. The bonus games include a program that automatically begins when the player achieves a qualifying condition in the base game.

In FIG. 1A, the reels 34 in an embodiment are simulated and the display device 30 is a video monitor. In certain instances the video display device 30 does not display the reels 34. For example, if a bonus game is triggered, the reel display discontinues and the bonus game display begins. The video display 30 may therefore include a touch screen that enables a player to input decisions into the gaming device 10 by sending a discrete signal based on the area of the touch screen that the player touches or presses. When the bonus game ends, gaming device 10 redisplays the reels 34.

In FIG. 1B, the reels 34 are mechanical and the central display device 30 is a mechanical display device having back lighting and any other features commonly found in connection with mechanical reels. To display a bonus game in combination with the mechanical reels 34 of the FIG. 1B, the upper display device 32 displays the bonus game. In such a case, the display device 32 is in an embodiment a video monitor and may include a touch screen. Here, the upper display device 32 remains blank or displays other indicia until a bonus game is triggered, whereby the video display device 32 displays the bonus game. When the bonus game ends, the upper display device 32 returns to a blank screen or screen having other indicia.

Any exposed area on the cabinet of gaming device 10, especially exposed areas facing the front of the gaming device, which are not consumed by one of the display devices 30 or 32 or the other functional components described above, may include the panels or displays of the present invention. In particular, the lower panel 38 on both the embodiments 10*a* and 10*b* of FIGS. 1A and 1B comprises a panel of one embodiment of the present invention. In FIG. 1A, one or both the lower panel 38 and the upper panel 40 are panels of the present invention.

Figure 2:
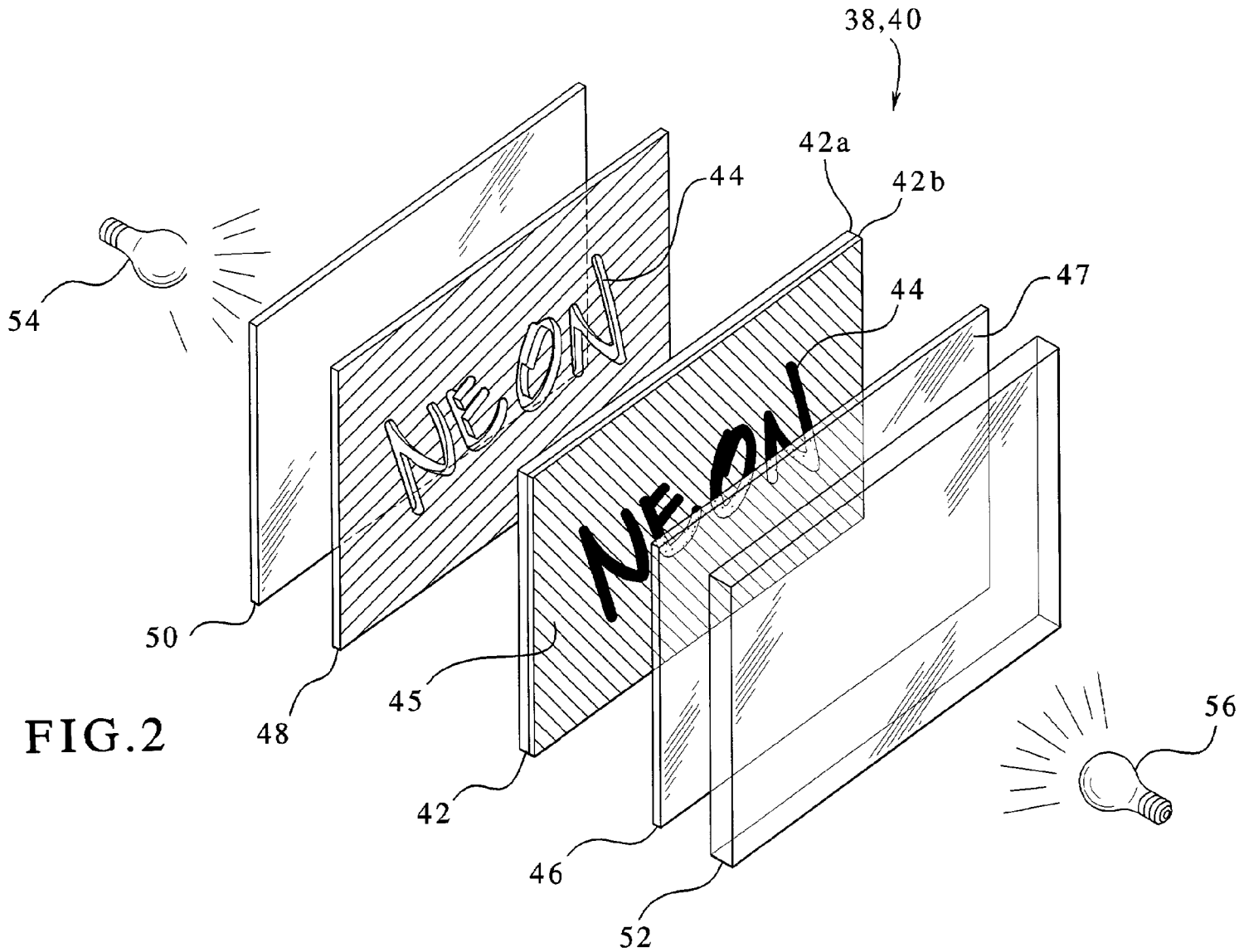
FIG. 2 is an exploded perspective view illustrating an improved panel or display produced according to one embodiment of a method of the present invention.

Referring now to FIG. 2, one embodiment of an improved panel or display 38 or 40 of the present invention is illustrated. While the panels or displays 38 and 40 are illustrated in FIGS. 1A and 1B as being lower front and upper front panels, respectively, panels or displays 38 and 40 may be disposed in any open location on the gaming device 10. The panel or display 38 or 40 includes a medium 42 having a positive image or indicia 44. In this case, the positive image 44 is the word "NEON." The positive image or indicia may be any image or indicia including words, objects, symbols, people, characters, structures, scenes, places, etc. Positive image 44 is produced by a digital imaging device and therefore may have any number of different colors including flesh tones and half-tones.

The medium 42 includes any suitable clear film or plastic, which exposes or enables the image 44 to be displayed. In a simplified embodiment, the medium 42 can be a clear plastic sheet that is sent through a color printer. The medium 42 in one embodiment is translucent. In a preferred embodiment, however, the medium 42 is transparent, so that a maximum amount of light passes through the medium.

In a preferred embodiment, the imaged medium 42 is a DURACLEAR™ display material by KODAK™. The DURACLEAR™ display material has a clear-base color transparency material 42*a*, which is a polyester of approximately 7 mils in thickness. The DURACLEAR™ display material has a layer of emulsion 42*b* of approximately 1 mil thickness. The image 44 is produced by an RA-4 process known to those of skill in the art. The RA-4 process generally involves the use of specialized chemicals, such as KODAK EKTACOLOR RA™ chemicals. Processing these materials in continuous roller transport processors, in trays, rotary tube processors or drum processors is know to those of skill in the art.

For the panels 38 and 40, a layer of double sided adhesive 46 is placed on the imaged side 42*b* of the medium 42. The double sided adhesive 46 can be any such adhesive known to those of skill in the art. The double sided adhesive 46 is in one embodiment transparent and has a thickness of approximately three mils. The double sided adhesive 46 in an embodiment has a release liner 47, which is disposed on the opposite side of the adhesive 46 from the medium 42. Release liner 47 enables an operator to handle the double sided adhesive 46 and properly place it over the image 44 of the medium 42. It should be appreciated that the adhesive 46 is only necessary when the medium 42 is to be adhered to a substrate, such as the substrate 52.

A silkscreen layer 48 is applied to the back of medium 42. That is, silkscreen layer 48 adheres to the transparency material 42*a* in the preferred embodiment. The silkscreen layer 48 is applied through any suitable method of silk-screening known to those of skill in the art. In a preferred embodiment, the layer 48 is a UV ink that is sent through a UV reactor to be cured.

The silkscreen layer 48 defines the same image 44 that appears as a positive image on the emulsion layer 42*b* of the medium 42. In a preferred embodiment, the silkscreen layer 48 is white and has the effect of making the transparent medium 42 translucent. The image 44 of the silkscreen layer 48 includes no UV ink, so that the light from light source 54 passes through the image 44 of the silkscreen layer 48. The overall effect is that a color 45 of the medium 42 appears richer and brighter because of the silkscreen layer 48 and the light shining through the image 44 of the medium 42 appears to make the image 44 glow or shine. The image 44 is thereby highlighted with respect to the surrounding color 45.

In this manner, the designer can selectively pick areas of the panel 38 or 40 that are more brightly back lit than other areas of the panel 38 or 40. By starting with a transparent material 42*a*, the white silkscreen layer 48 is selectively applied in the areas that the designer does not wish to be as brightly back lit. These areas however will reflect light from a source 56 outside of the gaming device 10 more readily than will the image 44 of the medium 42. In a preferred embodiment, the areas such as the image 44 that are not covered with silkscreen layer 48 and thereby made to be transparent are relatively small in area, such as the word "NEON". If the transparent area becomes too large, the panel 38 or 40 may begin to look washed out or dull.

A layer of laminate 50 covers the back of the panel 48, including the preferably white silkscreen of the layer 48 and the area of the non-inked image 44. The laminate 50 in one embodiment is optically clear polyester of approximately 1.5 mils. The transparent layer 50 enables all light from the light source 54 to pass through the layer. The layer 50 is applied for the purpose of protecting the silkscreen layer 48. That is, the laminate 50 keeps the silkscreen ink from being scratched or peeled off and protects the silkscreen ink from environmental exposure and handling damage.

In one embodiment, the imaged medium 42, the double sided adhesive 46, the silkscreen layer 48 and the laminate 50 are applied to a substrate 52 to produce the panel 38 or 40. The substrate 52 may be any clear glass or plastic known to those of skill in the art. In one embodiment, substrate 52 is 3/16 inch (4.8 millimeters) thick. In a preferred embodiment, the substrate 52 is glass, which may be tempered.

Figure 3:
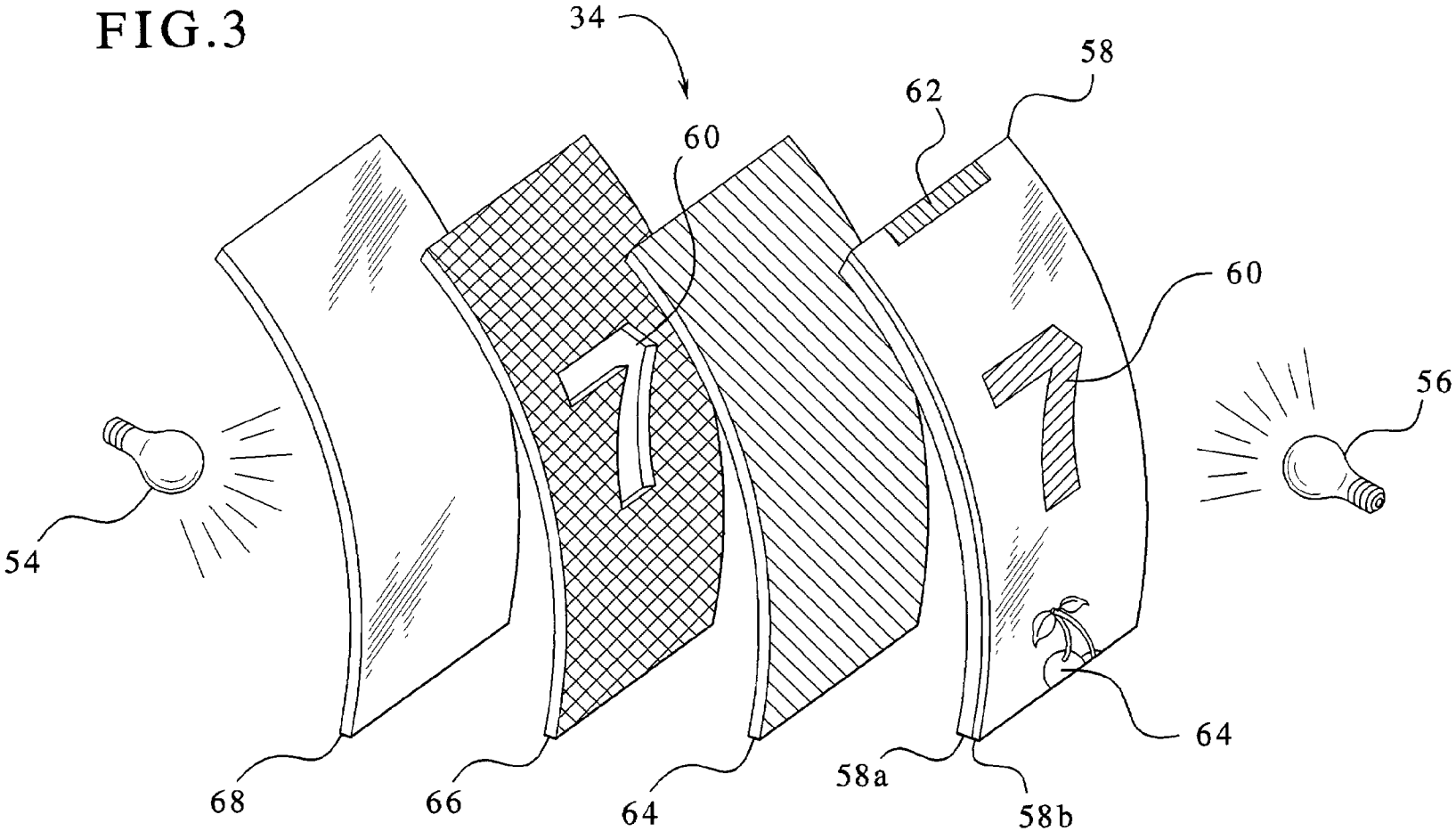
FIG. 3 is an exploded perspective view illustrating an improved reel strip or display produced according to one embodiment of a method of the present invention.

Referring to FIG. 3, one embodiment of an improved reel or reel strip 34 of the present invention is illustrated. The reel strip 34 includes a medium 58 having a positive image 60. In this case, the positive image 60 is the letter "7." The image or indicia 60, which is a symbol of the reel 34, may be any image including words, objects, symbols, people, characters, structures, scenes, places, etc. The image 60 has again been produced by a digital imaging device and therefore may have any number of different colors including flesh tones and half tones.

The medium 58 again includes any clear film or plastic that exposes or enables the image or indicia 60 to be displayed. In a preferred embodiment, the medium 58 is transparent, however, in an alternative embodiment the medium 58 is translucent.

The imaged medium 58 in a preferred embodiment is a DURACLEAR™ material. The DURACLEAR™ display material of the reel 34 has a clear-base color transparency material 58*a* which is a polyester of approximately 7 mils in thickness. The DURACLEAR™ display material also has the emulsion layer 58*b* of approximately one mil thickness. In one embodiment, the medium includes a polymeric material and a layer of emulsion. The image 60 is in one embodiment produced by the RA-4 process known to those of skill in the art.

For reference, a portion of separate symbols 62 and 64 are illustrated. The symbol 62 resides above the image 60. The symbol 64 resides below the image 60. Both the symbol 62 and the symbol 64 are produced through the RA-4 process described above.

Because the medium 58 does not mount to a substrate, such as the substrate 52 of FIG. 2, the double sided adhesive layer 46 of FIG. 2 is not necessary. Instead, the medium 58 receives two silkscreen layers 64 and 66. In the art of silk-screening, it is well known to apply a plurality of different colors using various screens, wherein one screen is used for each different color. Typically, a first color is applied and cured before a second color is applied, and so on.

Here a first layer of silkscreen ink 64 adheres to the back of the transparency material 58*a* of the medium 58. The silkscreen ink 64 is again preferably UV ink that is cured in a UV reactor. The UV ink layer 64 is preferably white. The white layer enables light emanating from light source 56 outside of the gaming device 10 to more readily reflect off of the colors of the image 60 and the symbols 62 and 64. That is, the symbols appear more rich and more brightly when the white silkscreen layer 64 adheres to the back of the medium 58.

The second silk screen layer 66 adheres to and resides on the first silkscreen layer 64 except in areas where the designer wishes back light from a light source 54 behind the reel 34 to shine through to the front of the gaming device 10. In this instance, the designer wishes the back light 54 to shine through and highlight the lucky 7 image 60 of the reel 58. Therefore, the silkscreen layer 66 is not applied in the area of image 60, which defines the number 7. In one embodiment, the second silkscreen layer 66 is black UV ink, which absorbs all of the back light from source 54. Other dark colors, such as dark blue, would also serve the purpose of absorbing most of the back light 54. The lucky 7 image 60 is thereby highlighted with respect to the other symbols 62 and 64 of the reel strip 34.

In alternative embodiments, a portion of the medium 58 is not inked so that a portion of the reel 34 remains transparent to further highlight selected areas. Further, alternatively, the embodiment of FIG. 3 can be produced using a translucent medium, such as DURATRANS™ day and night media by KODAK, instead of a transparent medium. Here, only a single dark or black silk-screened ink is selectively applied to produce the translucent and non-translucent image. Still further alternatively, a panel 38 or 40 can be made according to the dual inking process disclosed in connection with FIG. 3 and a reel 34 can be made according the single inking process disclosed in connection with FIG. 2.

As with the panel 38 or 40 of FIG. 2, the silkscreen layers 64 and 66 of the reel strip 34 are also in a preferred embodiment protected by a layer of laminate 68. The laminate 68 is again in one preferred embodiment a layer of polyester of approximately 1.5 mils thickness. The polyester layer protects the silkscreen layers 64 and 66 from scratching, tearing and moisture. In an alternative embodiment, the protective laminate includes a polymeric material.

Figure 4:
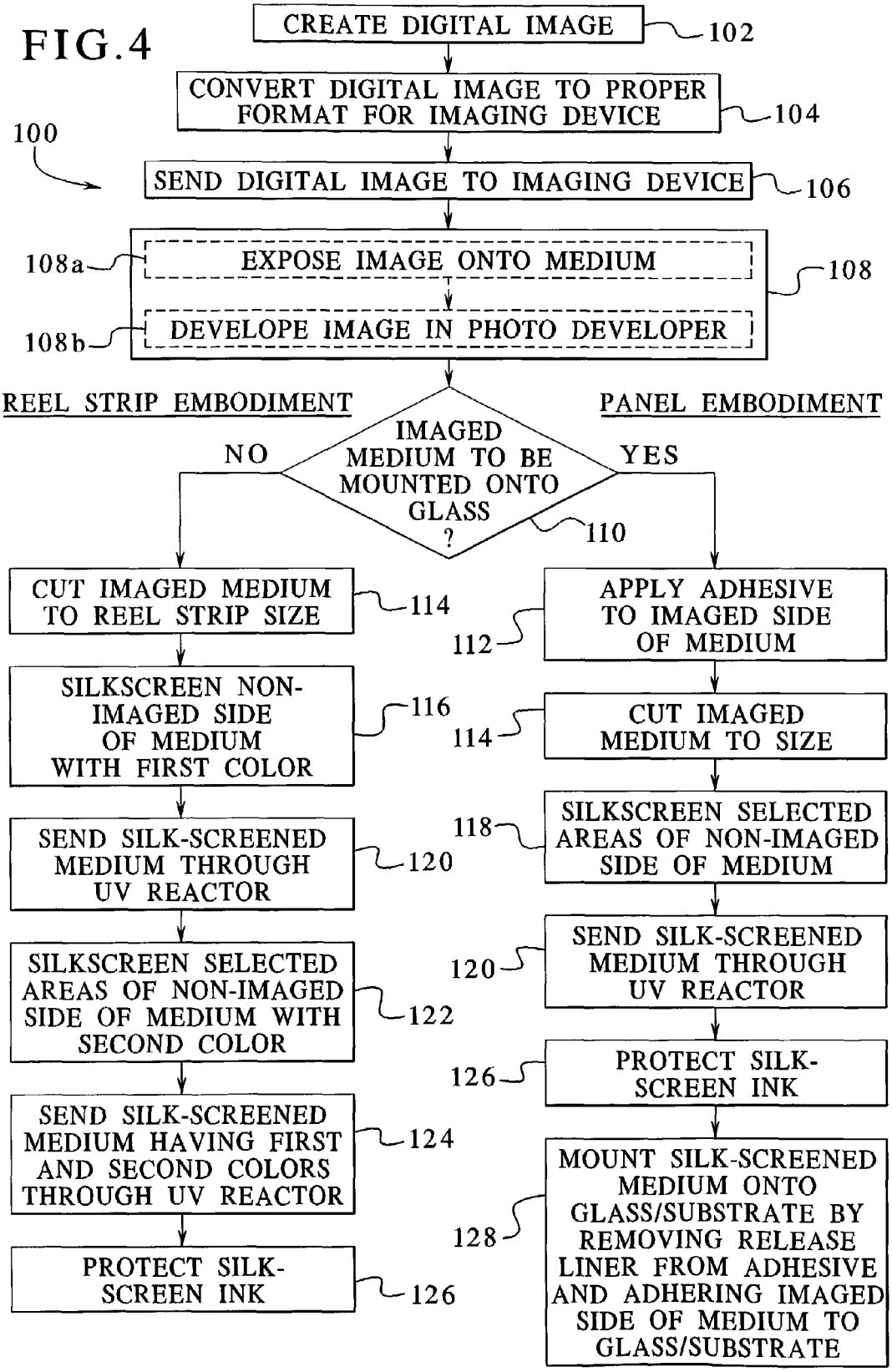
FIG. 4 is a schematic process flow diagram illustrating one embodiment of a method of the present invention.

Referring now to FIG. 4, one embodiment of a method 100 for the present invention is illustrated. The method 100 includes both embodiments for producing either a panel or a reel strip. The first step is to create a file for the digital image, as indicated by block 102. Typically, a designer draws and/or renders the digital image on a computer screen using known drawing software. The present invention includes any type of drawing software, image enhancement system, as well as PC and Macintosh™ files.

The next step is to take the digital image in the format created by the designer and to convert that format to the proper format for the imaging device, as indicated by block 104. Depending upon the imaging device, the format of the digital file may or may not need to be changed or converted. For example, if the digital image is created using a drawing package that outputs a DWG file, the drawing may be sent directly to a printer or plotter that produces the digital image without having to convert the file. The preferred imaging device described in more detail below requires that the drawing file be converted to a 24 bit TIFF file.

The designer then sends the digital image to the imaging device, as indicated by block 106. The digital imaging device can be any device known to those of skill in the art that produces a color image on a transparent or translucent film. The imaging device therefore includes laser printers, ink jet printers, plotters, scanners, dry film printers, drum-type printers or any other device capable of producing a multicolored image on a transparent or translucent substrate.

In the preferred embodiment, the digital imaging device includes a Durst Lambda™ 130 photographic imager. The Durst Lambda™ 130 imager outputs media up to 50 inches (127 cm) wide. The Durst Lambda™ 130 imager is a direct digital photographic printer that exposes a digital image directly from a computer file without the need for a negative or transparency. The Durst Lambda™ prints onto the emulsion layers 42*b* and 58*b* described above in connection with FIGS. 2 and 3, which include photographic silver-halide materials (color negative papers).

The photographic imager in an embodiment uses lasers including red, green and blue lasers to form a single calibrated beam of white light to expose the emulsion. The photographic imager can expose up to 200 ft (60 m) of the medium. Digital images having resolutions between 200 and 400 ppi (pixel per inch) may be achieved. Each color pixel is specified by one of 256 distinct levels of red, green and blue information and is imaged as one continuous tone point, achieving 16.7 million possible colors.

As indicated by block 108, the preferred photographic imaging device of the present invention includes two substeps indicated by blocks 108*a* and 108*b*. In the step indicated by block 108*a*, the digital image is sent to the photographic printer. The photographic printer which is in a preferred embodiment the Durst Lambda™ printer described above, includes a plurality of feed rolls of unexposed medium such as the DURACLEAR™ medium described above in connection with the medium 42 and the medium 58. The printer in an embodiment includes five of such rolls. The rolls may be of different sizes, for example, be capable of receiving a digital image of up to 50 inches (127 cm).

The panels 38 and 40 in one embodiment are 30 inches (76.2 cm) or 40 inches (101.6 cm) wide. The designer or operator selects one of the turrets or rolls from which to expose the digital image and also a number of digital images to print. The selected feed roll or turret unwinds the necessary medium, and a take-up roll receives the medium after the film has been exposed. The imaging machine cuts the film after the defined number of digital images have been exposed.

In the step indicated by block 108*b*, the take-up roll is removed from the photographic printer and transported to a photographic developer. The imaging device of the preferred embodiment therefore includes the photographic printer and the photographic developer. The process of exposing the image onto the medium with the layer of emulsion and transporting the exposed medium to the photographic developer is done in the dark so as not to prematurely develop the exposed medium, as is well known to those of skill in the art. A suitable photographic developer may be obtained from Colex Imaging Inc., Paramus, N.J. The Colex photographic processor is used to perform the RA-4 process. The photographic developer accepts the roll of exposed medium, unrolls the roll and develops the exposed image via the RA-4 process. The digital image then appears as a positive set of colors on the transparent material and is no longer light sensitive.

If the imaged medium is eventually displayed on a panel 38 or 40, the imaged medium is mounted to a substrate or glass, as indicated by diamond 110. If the imaged medium is eventually displayed on a reel strip 34, the imaged medium is not mounted to a substrate or glass as also indicated by diamond 110.

When the imaged medium is to be mounted on a reel strip, the next step is to cut the imaged medium to the proper reel strip size, as indicated by block 114. Next, an operator silk-screens the non-imaged side of the imaged medium with a first color, as indicated by block 116. As described above, the first layer of silk-screened ink is preferably white and covers all of or most of the non-imaged side of the medium. The operator then sends the medium having the first silkscreen layer of ink through a UV reactor, as indicated by block 120. The UV reactor cures the first layer of silk-screened ink as is well known. The operator then silk-screens selected areas of the non-imaged side of the medium with a second color, as indicated by block 122. As described above, the second layer of silk-screened ink is preferably light absorbing and most preferably black. The imaged medium then passes through the UV reactor another time with the second layer of silk-screened ink to cure the second layer, as indicated by block 124.

It should be appreciated that in one embodiment, the disclosed method of applying the first layer of silk-screened ink as white silk-screened ink and the second layer of silk-screened ink as dark or black silk-screened ink results in a visible image having a white background. That is, the application of white silk-screened ink to the transparent medium prior to the application of dark or black ink to the transparent medium results in a transparent or translucent wherein the white ink is visible. It should be further appreciated that when viewed in combination with the digital image, the disclosed imaged medium includes a single composite image including the digital image portion composited or combined with the white silk-screened background portion. Thus, in one embodiment, both the silk-screened layer and the digital image layer are simultaneously viewable from one of the sides of the medium to produce a desired image effect.

It should be appreciated that any number of layers of silk-screened ink may be applied to the non-imaged side of the medium, however, one of the advantages of the present invention is that the normal process of silk-screening is greatly simplified. First, only two layers of silk-screened ink are applied. Second, the first layer is applied to all or substantially all of the digitally imaged medium, so that the silkscreen process is greatly simplified. Also, the first layer is made without precisely registering the medium in any particular position. Further, FIG. 3 illustrates that the second layer of silk-screened ink 66 is also relatively simple and serves to highlight certain symbols on the reel strip, such as symbols that may represent a large award for the player.

The reel strip 34, with the multiple layers of silk-screened ink and the digitized image, receives a protective coating 68 to protect the silk-screened ink, as indicated by block 126. As described above, the protective coating in one preferred embodiment is a 1.5 mil layer of polyester. In other embodiments, any type of clear protective film or plastic may be used.

Referring now to the panel embodiment, after the image is developed onto the medium, an operator applies the preferably double sided adhesive to the imaged side of the medium, as indicated by block 112. The operator cuts the image to the proper size as indicated by block 114. As stated above, in one preferred embodiment, the width of the panel is 40 inches (101.6 cm), which is established by the width of the selected feed roll. The operator then cuts the medium to the proper height. If the medium contains a number of different images, the operator cuts or separates the images.

The non-imaged side of the medium receives a layer of silk-screened ink, as indicated by block 118. In the panel 38 or 40, as described above, the silkscreen blocks the ink from adhering to certain areas that the designer wishes to have enhanced back lighting. These areas in one preferred embodiment are relatively small and are limited to words or special symbols. The layer of silk-screened ink in an embodiment is white, which lets some back light through the panel, but also enables outside light to reflect and produce a rich and bright image on the front of the glass.

The operator in an embodiment only applies a single silk-screen layer, which makes certain areas of the transparent medium translucent. In alternative embodiments, the operator may apply multiple layers of silk-screened ink that overlap each other or reside in registry with one another. A polymer based protective coating is applied to the one or more layers of silk-screened ink, as indicated by block 126. The protective coating protects the silkscreen ink as described above.

The imaged medium, with one or more layers of silk-screened ink and a layer of adhesive, mounts to a desired substrate, as indicated by block 128. In one preferred embodiment the double sided adhesive includes a release liner that the operator removes to mount the medium to the substrate, such as glass. The release liner resides on the outside of the adhesive layer, so that the operator can readily remove the release liner to adhere the medium to the substrate.

The present invention also contemplates making the screens for the silk-screening using a similar process to that described above for making the digital image. That is, the screens are made using the photographic printer and the photographic developer. The silkscreen is first created by the designer on a computer screen. The designer sends a drawing file containing the silkscreen design in the proper format to the photographic printer. The photographic printer exposes the image onto a medium, for example, the same medium used for the panels and the reel strip. The photographic developer develops the exposed medium to produce a negative/black image of the silkscreen.

The image is attached to the screen, wherein the screen is coated with a layer of emulsion. The silkscreen having the attached image is then exposed to UV light, which creates a negative of the image. Once the screen is exposed to UV light, the operator washes the screen to remove the image from the screen. When the screen dries, the operator removes any unwanted portions or imperfections from the screen, wherein the screen is then ready for printing.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming device comprising:

a housing;

a display device supported by the housing and configured to display a game operable upon a wager;

a light source positioned within the housing; and a panel supported by the housing, said panel including a single medium having a viewable side and an opposing side, the opposing side of the panel positioned adjacent to the light source, a digital image disposed directly on said viewable side of the single medium, a first silk-screened layer disposed directly on the opposing side of the single medium from the digital image, a second silk-screened layer disposed on the opposing side of the single medium from the digital image, the second silk-screened layer overlapping at least a portion of the first silk-screened layer, the first silk-screened layer including a non-overlapping portion which is not overlapped by the second silk-screened layer, the first silk-screened layer and the second silk-screened layer having different degrees of opacity to cause more light from the light source to pass through the non-overlapping portion than the overlapping portion, said digital image having a shape, wherein at least a portion of said digital image is highlighted by the light from the light source passing through the non-overlapping portion of the first silk-screened layer.

2. The gaming device of claim 1, wherein the non-overlapping portion of the first silk-screened layer has a shape that is formed around a projection of the shape of the digital image on the opposing side of the single medium.

3. The gaming device of claim 1, wherein the non-overlapping portion of the first silk-screened layer has a shape that is formed around selected portions of a projection of the shape of the digital image on the opposing side of the single medium.

4. The gaming device of claim 1, wherein the digital image includes half-tones and flesh tones.

5. The gaming device of claim 1, wherein the first silk-screened layer includes white ink.

6. The gaming device of claim 1, wherein the non-overlapping portion of the first silk-screened layer has a shape that coincides with the shape of the digital image.

7. The gaming device of claim 1, wherein the digital image includes a plurality of portions and wherein the non-overlapping portion of the first silk-screened layer enables light to shine through at least one of the portions of the digital image.

8. The gaming device of claim 1, wherein the digital image includes a plurality of portions and wherein the overlapping portion of the first and second silk-screened layer-layers at least partially prevents light from shining through at least one of the portions of the digital image.

9. The gaming device of claim 1, wherein the single medium includes a polymeric material and a layer of emulsion.

10. The gaming device of claim 9, wherein the polymeric material is transparent or translucent.

11. The gaming device of claim 1, wherein the digital image is produced through a photographic process.

12. The gaming device of claim 1, wherein the digital image is produced through an RA-4 process.

13. The gaming device of claim 1, wherein the first and second silk-screened layers are covered by a protective laminate.

14. The gaming device of claim 13, wherein the protective laminate includes a polymeric material.

15. The gaming device of claim 1, wherein the first silk-screened layer is applied uniformly onto the entire opposing side of the medium.

16. The gaming device of claim 15, wherein the second silk-screened layer is disposed directly on the first silk-screened layer which is disposed directly on the single medium opposite the digital image.

17. The gaming device of claim 15, wherein the non-overlapping portion of the first silk-screened layer causes a portion of the digital image to be translucent and the overlapping portion of the first and second silk-screened layers causes a portion of the digital image to be opaque.

18. A gaming device comprising:

a housing;

a display device supported by the housing and configured to display a game operable upon a wager; and a panel supported by the housing, said panel including a single medium, a digital image disposed directly on a first side of the single medium, a first silk-screened layer disposed directly on a second side of the single medium, a second silk-screened layer disposed on the first silk-screened layer, the first silk-screened layer and the second silk-screened layer having different degrees of opacity, and a panel substrate disposed on the first side of the single medium, said digital image including a shaped symbol and said second silk-screened layer including a shaped symbol related to the shaped symbol of the digital image, wherein at least a portion of said digital image, at least a portion of said first silk-screened layer and at least a portion of said second silk-screened layer are each simultaneously viewable from the first side of the single medium, and wherein said shaped symbol of said digital image and said shaped symbol of said second silk-screened layer form one of a plurality of different parts of a composite image viewable from the first side of the single medium.

19. The gaming device of claim 18, wherein the panel substrate includes glass.

20. The gaming device of claim 18, wherein the panel substrate includes tempered glass.

21. The gaming device of claim 18, which includes an adhesive release liner that adheres the single medium to the panel substrate.

22. The gaming device of claim 18, which includes a protective laminate disposed on the second side of the single medium.

23. A gaming device comprising:

a housing;

a display device supported by the housing and configured to display a game operable upon a wager;

at least one reel strip supported by the housing, said reel strip including a single medium, a digital image disposed directly on a first side of the single medium, a first silk-screened layer disposed directly on a second side of the single medium, and a second silk-screened layer disposed on a portion of the first silk-screened layer, the first silk-screened layer including a non-overlapping portion which is not overlapped by the second silk-screened layer, the first silk-screened layer and the second silk-screened layer having different degrees of opacity, said digital image having including a shaped symbol and said non-overlapping portion of the first silk-screened layer having a shape related to the shape of the digital image, wherein at least a portion of said digital image and at least a portion of said overlapping first and second silk-screened layers are each simultaneously viewable from the first side of the single medium, and wherein the shaped symbol of the digital image and the shape of the non-overlapping portion of the first silk-screened layer form one of a plurality of different parts of a composite viewable image of said reel strip when said reel strip is viewed from the first side of the single medium; and a back-light disposed in the housing behind the silk screened layer of the single medium.

24. The gaming device of claim 23, wherein the non-overlapping portion of the first silk-screened layer causes a portion of the composite viewable image to be translucent and the overlapping portion of the first and second silk-screened layer-layers causes a portion of the composite viewable image to be opaque.

25. The gaming device of claim 23, which includes a protective laminate disposed over the first and second silk-screened layers on the second side of the single medium.

26. A method of producing a gaming device having a housing, a game operable upon a wager, and a composite viewable image formed on a single medium connected to the housing, the method comprising the steps of:

disposing a digital image directly on a first side of the single medium, the digital image including a shaped symbol;

silk-screening a first layer directly on a second side of the single medium, silk-screening a second layer on the first layer, the first silk-screened layer and the second silk-screened layer having different degrees of opacity, the second silk-screened layer including a shaped symbol related to the shaped symbol of the digital image, and the second side of the single medium opposing the first side of the single medium such that at least a portion of the digital image, at least a portion of the first silk-screened layer, and at least a portion of the second silk-screened layer are each simultaneously viewable from the first side of the single medium, and wherein the shaped symbol of the digital image and the shaped symbol of the second silk-screened layer form one of a plurality of different parts of said composite viewable image formed on the single medium;

mounting the single medium to the housing; and back-lighting the second silk-screened layer from behind the second silk-screened layer to allow at least some light to pass through both the digital image and the second silk-screened layer when said single medium is viewed from the first side of the single medium.

27. The method of claim 26, wherein the step of mounting the single medium includes mounting the single medium on a panel attached to the housing.

28. The method of claim 26, wherein the step of mounting the single medium includes mounting the single medium on a reel rotatably connected to the housing.

29. A method of producing a gaming device having a housing, a game operable upon a wager, a display device supported by the housing and operable to display the game and a composite viewable image formed on a single medium connected to the housing, the method comprising the steps of:

creating a digital image;

exposing the digital image directly onto an imaged side of the single medium, the digital image including a shaped symbol;

photographically developing the digital image exposed directly onto the imaged side of the single medium;

silk-screening a first layer directly on a non-imaged side of the single medium, silk-screening a second layer on the first silk-screened layer, the first silk-screened layer and the second silk-screened layer having different degrees of opacity, the second silk-screened layer including a shaped symbol related to the shaped symbol of the digital image, and the non-imaged side of the single medium being opposite from the imaged side of the single medium such that at least a portion of the first silk-screened layer, at least a portion of the second silk-screened layer, and at least a portion of the digital image are each simultaneously viewable from the imaged side of the single medium and the shaped symbol of the digital image and the shaped symbol of the second silk-screened layer form one of a plurality of different parts of said composite viewable image formed on the single medium when said composite viewable image is viewed from the imaged side of the single medium;

moving the single medium through an ultraviolet reactor;

protecting the first silk-screened layer; and mounting the single medium to the housing.

30. The method of claim 29, which includes the step of converting the digital image to a format readable by a digital imaging device and thereafter exposing the image onto one side of the single medium using the digital imaging device.

31. The method of claim 29, wherein the gaming device is a slot machine and which includes the step of cutting the single medium to a size of a slot machine reel.

32. The method of claim 29, which includes the steps of applying a protective layer to the imaged side of the single medium and cutting the single medium to a size of a slot machine panel.

33. The method of claim 32, which includes the further steps of removing a releasable liner from the protective layer, wherein the protective layer includes a double adhesive protective layer, and adhering the single medium, via the released side of the adhesive layer, to the slot machine panel.

* * * * *